US005925434A

United States Patent [19]

Phillips et al.

[11] Patent Number: 5,925,434

[45] Date of Patent: Jul. 20, 1999

[54] TUFTABLE BACKING AND CARPET CONSTRUCTION

[75] Inventors: Charles F. Phillips, Sharpsburg; Edward Barkis, Marietta; Robert W. Amick, Kennesaw; Kenneth R. Jones, Rossville, all of Ga.

[73] Assignee: BP Amoco Corporation, Chicago, Ill.

[21] Appl. No.: 08/873,650

[22] Filed: Jun. 12, 1997

[51] Int. Cl.[6] ..... B32B 3/02

[52] U.S. Cl. ..... 428/95; 428/97; 442/46; 442/60; 442/62; 442/186; 442/192

[58] Field of Search ..... 428/95, 97; 442/46, 442/60, 62, 186, 192

[56] References Cited

U.S. PATENT DOCUMENTS

| | | | |
|---|---|---|---|
| H90 | 7/1986 | Kumar | 66/192 |
| 3,349,552 | 10/1967 | Port et al. | 57/31 |
| 3,359,934 | 12/1967 | Schwartz et al. | 112/410 |
| 3,398,220 | 8/1968 | Port et al. | 264/147 |
| 3,403,068 | 9/1968 | Yost | 161/130 |
| 3,413,176 | 11/1968 | Port et al. | 156/499 |
| 3,439,865 | 4/1969 | Port et al. | 229/53 |
| 3,445,055 | 5/1969 | Port et al. | 229/53 |
| 3,492,389 | 1/1970 | Port et al. | 264/147 |
| 3,503,106 | 3/1970 | Port et al. | 28/72 |
| 3,613,612 | 10/1971 | Kennedy | 112/410 |
| 3,617,413 | 11/1971 | Elbert | 156/61 |
| 3,639,573 | 2/1972 | Port | 264/75 |
| 3,735,537 | 5/1973 | Panker | 52/660 |
| 3,760,046 | 9/1973 | Schwartz et al. | 264/47 |
| 3,779,799 | 12/1973 | Kennedy et al. | 117/161 UZ |
| 3,914,365 | 10/1975 | Kim et al. | 264/147 |
| 3,919,097 | 11/1975 | Park | 252/48.6 |
| 4,104,428 | 8/1978 | Liu et al. | 428/85 |
| 4,107,259 | 8/1978 | Liu et al. | 264/331 |
| 4,123,577 | 10/1978 | Port et al. | 428/95 |
| 4,268,577 | 5/1981 | Fahey | 428/394 |
| 4,288,331 | 9/1981 | Shepley et al. | 252/8.81 |
| 4,348,244 | 9/1982 | Shepley et al. | 156/72 |
| 4,478,900 | 10/1984 | Nebe et al. | 428/92 |
| 4,556,602 | 12/1985 | Williams | 428/259 |
| 4,643,119 | 2/1987 | Langston et al. | 428/35.5 |
| 5,445,860 | 8/1995 | Bova | 428/87 |
| 5,578,370 | 11/1996 | Ferrar et al. | 428/311.11 |

FOREIGN PATENT DOCUMENTS 6221862 1/1987 Japan .

OTHER PUBLICATIONS

Properties of Roll–embossed Yarns by A. F. Aspin and D. W. Wall, 'Polypropylene fibres and textiles' (Plastics & Rubber Institute), London, UK 1979, 26.1–26.9 (9 pages).

Japanese Laid–Open Patent Application (Kokai) No. 62–21862, Jan. 30, 1987.

*Primary Examiner*—Terrel Morris

*Attorney, Agent, or Firm*—Scott P. McDonald; Stephen L. Hensley

[57] ABSTRACT

Improved tuftable primary backings, carpets made from the backings and methods for making backings are disclosed. The backings employ fabrics made from serrated tape yarns which are coated with a film of a thermoplastic material, and optionally include a tufting lubricant applied to at least a portion of the serrated yarns.

28 Claims, 3 Drawing Sheets

TUFTABLE BACKING AND CARPET CONSTRUCTION

FIELD OF THE INVENTION

The invention generally relates to backings useful for constructing tufted materials. More particularly, the invention relates to tuftable backings which employ serrated tape yarns, to carpets manufactured using the backings, and to methods for making the backings.

BACKGROUND OF THE INVENTION

In recent years, U.S. carpet manufacturers annually have produced over one billion square yards of carpet. Typically, at least ninety five percent of carpet manufactured in the U.S. is tufted carpet.

A tufted carpet is manufactured by inserting reciprocating needles threaded with a face yarn through a primary carpet backing to form loops or "tufts" of yarn in the primary backing. The tufted primary backing then is washed, dyed if desired, dried and finished. The finishing process typically includes the steps of applying a particulate-filled latex binder to the back of the tufted primary backing to secure the tufts in the primary backing and to adhere a secondary backing to the tufted primary backing.

Primary carpet backings are the foundation of tufted carpet, as the quality, appearance and dimensional stability of tufted carpets depends in large part on the properties of the primary backing. Primary backings can be produced from woven or non-woven materials, and, while both types of materials have advantages, each also has inherent disadvantages.

Woven primary backings can be produced from natural materials such as jute, cotton or kraftcord, or from synthetic materials such as thermoplastic yarns. While woven primary backings are widely used commercially to produce tufted carpet, most woven primary backings can cause tufting needles to deflect during the tufting process, yielding finished carpet that has an uneven or "choppy" appearance. While it is known that needle deflection-related problems in woven backings may be reduced by using flat or fibrillated tape yarns which are more easily split by tufting needles, such yarns typically exhibit reduced tensile strength, especially after being repeatedly pierced during the tufting process. Woven primary backings also often exhibit a tendency to unravel or fray, and have limited dimensional stability because the warp and fill yarns can shift position within the woven material.

Efforts have been made to reduce needle deflection problems in woven primary backings by using lubricants to enhance the ability of needles to penetrate backing yarns. For example, U.S. Pat. No. 3,613,612 teaches the use of 0.2 to 12 weight percent of a tufting needle lubricant on a woven fabric to reduce needle shattering. While the use of such a lubricant may enhance the ability of a needle to penetrate a flat yarn, the lubricant does nothing to prevent fraying or unraveling, and in fact may increase such problems as the lubricant may make it easier for the warp and fill yarns to move relative to one another in the woven material.

Non-woven primary backings typically are spunbonded thermoplastic webs formed from one or more polyesters, polyolefins or combinations of those materials. While non-woven backing fibers are not susceptible to the unraveling and needle deflection problems noted above, the strength and dimensional stability of such a nonwoven backing deteriorates rapidly as the backing repeatedly is pierced by the tufting needles. Carpets made from non-woven fabrics therefore often have lower tuft retention than carpets made from woven materials. Lower tuft retention means that tufts may be more easily pulled from tufted nonwoven primary backings during the carpet finishing process, yielding carpet that has an uneven finished appearance.

Because both woven and nonwoven carpet backings exhibit undesirable performance characteristics, carpet backing manufacturers have attempted to manufacture improved backings by combining woven backings with supplemental materials to enhance the dimensional stability of woven backings and to reduce fraying of the woven material.

Japanese Laid Open Patent Application No. 62-21862 discloses a primary backing fabric for tufted carpets in which polypropylene tape yarns having concave surface nodes are woven into a fabric which is subsequently laminated to a polypropylene film. While the inventors claim to have produced a backing having improved tuftability and dimensional stability, we believe that polypropylene tape yarn/polypropylene film laminates such as those disclosed in this application cause unacceptably high needle deflection and breakage and that the use of a lamination process prevents such backings from being efficiently produced in large quantities. Therefore, we believe these backings are unsuitable for use in many commercial applications.

U.S. Pat. No. 3,779,799 describes yet another attempt to modify a woven fabric to obtain improved dimensional stability and anti-fray performance. In this patent, a woven material is sprayed or roll-coated with a polymeric substance such as an ethyl vinyl acetate copolymer in an amount of about 0.5 to 0.9 ounces per yard of backing. While the use of the sprayed co-polymer may reduce fraying of the woven material, the drying and curing of the sprayed coating represents a substantial disadvantage when attempting to produce large quantities of such a primary backing. Additionally, sprayed or rolled coatings such as those disclosed in the '799 patent are believed to be incapable of providing backings having sufficient dimensional stability and grab strength for use in demanding applications.

Despite the availability of primary carpet backings such as those described above, the carpet industry continues to demand improved primary backings that are easily tufted, possess high dimensional stability, grab strength and fray resistance, and that can be reliably and easily produced in the large quantities required by carpet manufacturers.

SUMMARY OF THE INVENTION

Surprisingly, we have found that improved primary backings can be produced by coating a polymeric layer onto fabrics woven at least in part from serrated tape yarns. The performance of such backings can be further improved through the use of serrated tape yarns having certain cross sectional shapes.

The performance of the backings also can be enhanced by applying lubricants to at least some of the yarns used in the woven material. This improvement is particularly surprising given that the presence of a tufting lubricant on a woven fabric would be expected to interfere with the ability of a polymeric layer to adhere to the woven material.

More specifically, a first embodiment of the invention is a tuftable backing made by adhering a thermoplastic layer onto a fabric woven at least in part from serrated tape yarns which optionally bear a tufting lubricant. The backing is easily tufted, resists fraying, and exhibits improved dimensional stability and grab strength when compared to similar backings made from non-serrated tape yarns. In preferred embodiments of this invention, improved backing performance is obtained by using serrated tape yarns that have relatively flat topped ridges or "mesas" rising above at least one major yarn surface.

In another embodiment of the invention, a tuftable backing material includes a fabric woven from yarns comprising thermoplastic tape yarns having at least one longitudinal channel located on at least one major yarn surface and a thermoplastic coating adhered to the fabric. The thermoplastic coating extends downwardly into at least some of longitudinal channels, at least partially and preferentially completely filling the channels.

In still another embodiment of the invention, carpets are produced by tufting a face yarn through a primary backing woven from at least 50 percent of thermoplastic serrated tape yarn and which bears a thermoplastic polymeric film adhered onto the woven fabric. In preferred embodiments, the backings' polymeric film is extrusion coated onto the woven fabric. The carpets exhibit improved dimensional stability and grab strength, resist fraying, and are used advantageously in vehicular and carpet tile applications.

In yet another embodiment of the invention, a process for producing a primary carpet backing is disclosed. The process includes the steps of extruding a thermoplastic material through a die to form a sheet material bearing longitudinal serrations; cutting the sheet material to form a plurality of serrated tape yarns; lubricating at least a portion of the serrated tape yarns with a tufting lubricant; weaving a woven material comprising the serrated tape yarns; and thereafter extrusion coating a thermoplastic material onto the woven material. Despite the presence of lubricant on the serrated yarn during the extrusion coating step, we have found that the extrusion coating adheres surprisingly well to the woven material and that the process yields a primary backing having excellent tuftability, fray resistance, dimensional stability and grab strength.

DETAILED DESCRIPTION OF THE INVENTION

Presented below are several examples of tuftable backings, carpets made from such backings, and processes useful for the manufacture of the backings. Backings constructed according to the invention employ woven materials formed at least in part from serrated tape yarns. In each case, a thermoplastic material is adhered to the woven material in such a manner as to allow at least some serrated tape yarn surfaces to be oriented against the thermoplastic material. Backings constructed in this manner provide excellent dimensional stability, fray resistance, tuftability and grab strength when compared to other backing materials used in similar applications.

While the following examples focus on processing carpet backing applications, the invention can be exploited to prepare stable, tuftable backing materials for a wide variety of applications.

Figure 1:
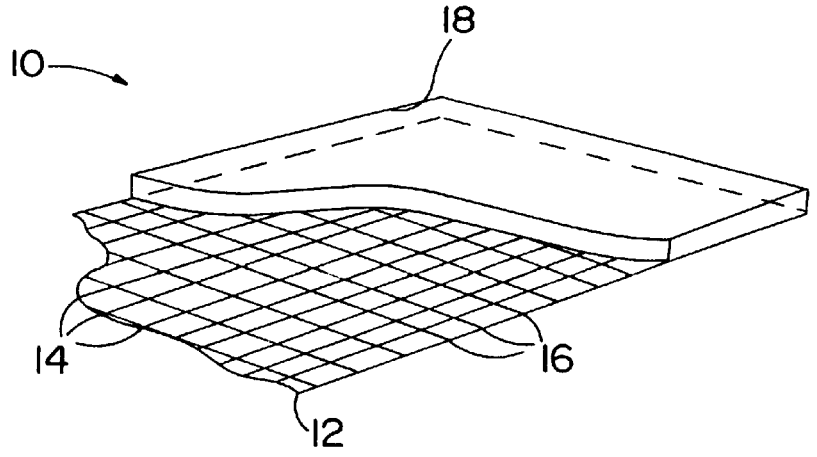
FIG. 1 is a simplified perspective view of a primary carpet backing in accordance with the present invention.

FIG. 1 is a simplified perspective view illustrating one embodiment of a primary carpet backing in accordance with the invention.

In FIG. 1, a primary backing 10 includes a plain weave material 12 woven from serrated polypropylene warp yarns 14 and fill yarns 16. Warp yarns 14 bear tufting lubricants on their outer surfaces and are discussed in greater detail in connection with FIG. 2. Woven material 12 has a yarn count of approximately 9.5 warp yarns 14 per centimeter (24 warp yarns/in.) and approximately 4.3 fill yarns 16 per centimeter (11 fill yarns/in.).

Backing 10 also includes an extrusion coating 18 of a polyolefinic alloy containing about seventy five weight percent polypropylene and about twenty five weight percent polyethylene. Extrusion coating 18 is approximately 0.025 millimeters ( 0.001 in.) thick.

Figure 2:
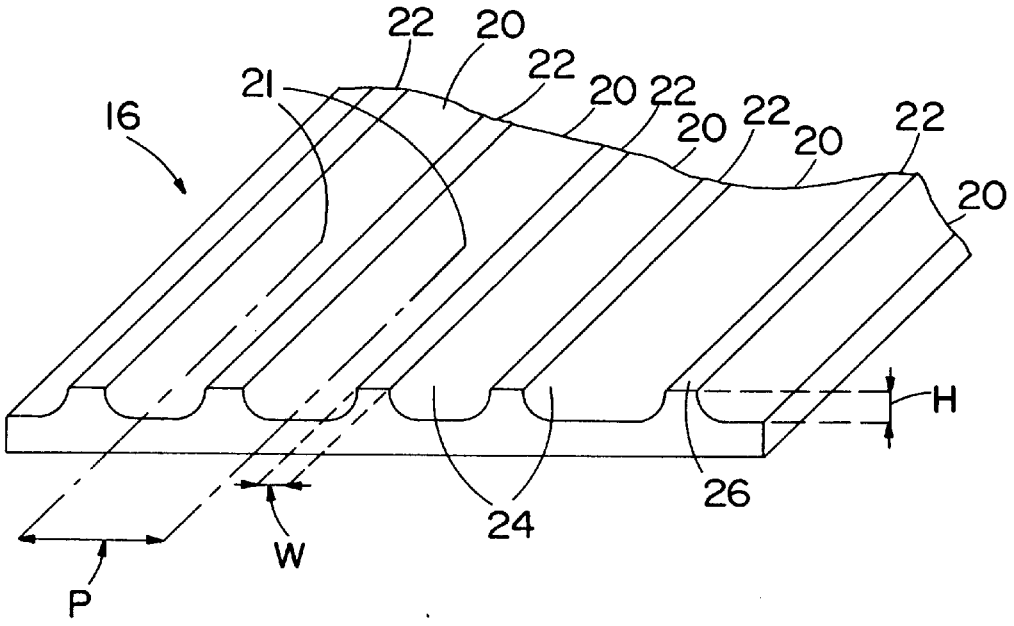
FIG. 2 is a perspective sectional view of a serrated tape yarn useful in the present invention.

Yarns 14 and 16 are serrated tape yarns having a profile typified by the perspective view of fill yarn 16 shown in FIG. 2. Yarn 16 is about 2 millimeters (100 mils) wide and about 0.08 millimeters (3 mils) thick at its thickest point. The cross section of yarn 14 exhibits a plurality of serrations 20 having a pitch P of about 0.3–0.4 millimeters (12 to 16 mils) as measured from one serration 20 to an adjacent serration 20. Serrations 20 include a groove or channel 21 and a ridge or "mesa" 22 rising to a height H approximately 0.4 millimeters (1.6 mils) above the lowest point of channels 21. Mesas 22 have generally concave sides 24 and generally flat tops 26, with tops 26 having widths W of approximately approximately 0.1 to 0.2 millimeters (4 to 8 mils). Warp yarns 14 are dimensionally similar to fill yarns 16 except that warp yarns 14 are approximately half as wide as fill yarns 16. Each warp yarn 14 bears approximately 2 to 3 weight percent of a tufting lubricant, such as the ethylene-modified fatty acid available commercially as MILLIKEN'S TUFTING FINISH from Milliken's Chemicals of Spartanburg, S.C.

The first step in manufacturing backing 10 is to form serrated warp and fill yarns 14 and 16. Yarns 14 and 16 are produced by extruding polypropylene through a die having a shape capable of producing a serrated sheet that can be cut and drawn to produce tape yarns of the desired dimensions. In this case, the extruded sheets are approximately 183 centimeters (72 in.) wide and contain about 20 serrations per centimeter (50 serrations/in.) across their width. The extruded sheet is water quenched, the water stripped from the quenched sheet, and the sheet slit into tape yarns having a width which, after drawing, will correspond to the desired warp and fill yarn dimensions. The stripped tape yarns are then drawn in a drawing oven at a temperature of about 160° Centigrade (320° F.) at a drawing ratio of about 6.8 to 1, relaxed 12 percent, and wound on to spools for use in the weaving process. The warp and fill yarns are approximately 475 and 1050 denier, respectively. It should be noted that the pitch of the serrations decreases about 30% as a result of the drawing process.

The tufting lubricant is applied to the warp yarn by a kiss roll during beaming of the yarn.

The serrated warp and fill yarns are woven into a plain weave roll material having a width of about 3.8 meters (10 ft.).

A mixture of 75 weight percent polypropylene and 25 weight percent polyethylene is extrusion coated onto the woven fabric through a slot die having an opening approximately equal to the width of the fabric at a melt temperature of about 300° Centigrade (572° F.). The extrudate-bearing fabric is quenched on a chill roll immediately after the extrudate is applied.

We have found that primary backing materials prepared in accordance with the foregoing description provide exceptional advantages in tufted carpet applications. When compared to similar primary backings made using flat ribbon yarns or uncoated serrated yarns, the use of primary backings such as those described above has reduced mechanical contraction of the primary backing and needle deflection problems during tufting, and has produced tufted material having improved grab strength and visual appearance, as demonstrated by the following Examples.

EXAMPLE 1

A primary backing in accordance with the present invention was prepared, tufted and tested to measure the grab strength and visual appearance of the tufted product.

The woven material used in the primary backing was prepared from serrated tape warp and fill yarns produced by extruding, slitting, and drawing polypropylene yarns as discussed above. The warp yarn used to prepare the woven material was a serrated 350 denier yarn about 1 millimeter wide and having about 3 serrations across its width. The cross-sectional shape of the yarn was similar to that shown in FIG. 2. The fill yarn was a 845 denier yarn about 2 millimeters wide having about 6 serrations across its width. The warp yarn was lubricated with 2 to 3 weight percent of Milliken's Tufting Lubricant prior to weaving. The warp and fill yarns were plain woven to yield a material having about 9.5 warp yarns per centimeter (24 warp yarns/in.) and 3.5 fill yarns per centimeter (9 fill yarns/in.).

Following weaving, a 0.025 millimeter (0.001 in.) thick film of a 75/25 weight percent polypropylene/polyethylene blend was extrusion coated onto one side of the woven material. The extrusion coated blend was applied at a melt temperature of about 300° C. (575° F.), and the finished weight of the coating was about 18 grams/square meter (0.75 ounce/yd). The coated backing was tufted at 1/10 gauge with a 1465 denier polypropylene tufting yarn to produce a cut pile carpet having a uniform visual appearance.

The grab strength of the tufted material was tested using an Instron tensile strength tester by a procedure substantially similar to ASTM D-5034, "Standard Test Method for Breaking Load and Elongation of Textile Fabrics and Geotextiles." The tufted material exhibited a grab strength in the fill direction of 86 pounds and a grab strength in the warp direction of 143 pounds, with each stated grab strength being the average of the peak breaking strength of five test samples.

COMPARATIVE EXAMPLE 1

A tufted backing was prepared and tested as in Example 1 except that the woven material was not extrusion coated. The grab strength of the tufted backing was 64 pounds in the fill direction and 123 pounds in the warp direction, and the tufted backing exhibited a generally inferior, choppy appearance when compared side by side with the tufted backing of Example 1.

The improved grab strength and visual appearance of the tufted backing of Example 1 when compared to the backing of Comparative Example 1 illustrates the superiority of coated, serrated tape backings over uncoated backings woven from serrated tapes.

Tufted, coated serrated tape backings in accordance with the present invention also exhibit superior visual appearance and grab strength when compared to similar backings made from non-serrated yarns as illustrated by Example 2 and Comparative Example 2, below.

EXAMPLE 2

A coated serrated tape yarn backing was prepared as in Example 1. The fill yarn used to prepare the woven material was a 2 millimeter wide, serrated 845 denier yarn having about 6 serrations across its width and a cross-sectional shape similar to that shown in FIG. 2. The warp yarn was a 1 millimeter wide 350 denier yarn having about 3 serrations across its width. The warp yarn was lubricated with 2 to 3 weight percent of Milliken's Tufting Lubricant prior to weaving. The warp and fill yarns were plain woven to yield a material having about 9.8 warp yarns per centimeter (24 warp yarns/in.) and 4.3 fill yarns per centimeter (11 fill yarns/in.).

As in Example 1, a 0.025 millimeter (0.001 in.) thick film of a 75/25 weight percent polypropylene/polyethylene blend was extrusion coated onto one side of the woven material, and the coated backing was tufted at 1/10 gauge with a 1465 denier polypropylene tufting yarn to produce a cut pile carpet having a uniform visual appearance.

The grab strength of the tufted material was tested using an Instron tensile strength tester as described in Example 1. The tufted material exhibited a grab strength in the fill direction of 82 pounds and a grab strength in the warp direction of 147 pounds.

COMPARATIVE EXAMPLE 2

A tufted backing was prepared as in Example 2 except that flat ribbon warp and fill yarns of 500 and 1,000 denier having widths of approximately 1.1 and 2.6 centimeters, respectively, were used in place of serrated tape yarns. The visual appearance of the tufted backing when compared to Example 1 was less uniform, and the grab strengths in the warp and fill directions as measured by the method of Example 1 were 148 pounds in the warp direction and 75 pounds in the fill direction.

Comparative Example 2 demonstrates that heavier denier flat yarns are required in woven, coated backings to obtain the same grab strengths as backings made from relatively lighter serrated tape yarns. This again demonstrates the superiority of serrated tape backings in accordance with the present invention.

The use of a lubricant on the warp yarns in backings of the present invention provides improved performance over similar backings which do not incorporate a lubricant. This superior performance is demonstrated by Example 3 and Comparative Example 3, below.

EXAMPLE 3

A coated, serrated tape yarn backing was prepared as in Example 1. The fill yarn used to prepare the woven material was a 2 millimeter wide, serrated 845 denier polypropylene yarn having about 6 serrations across its width and a cross-sectional shape similar to that shown in FIG. 2. The warp yarn was a 1 millimeter wide 350 denier polypropylene yarn having about 3 serrations across its width. The warp yarn was lubricated with 2 to 3 weight percent of Milliken's Tufting Lubricant prior to weaving. The warp and fill yarns were plain woven to yield a material having about 9.8 warp yarns per centimeter (24 warp yarns/in.) and 4.3 fill yarns per centimeter (11 fill yarns/in.).

Following weaving, a 0.025 millimeter (0.001 in.) thick film of a 75/25 weight percent polypropylene/polyethylene blend was extrusion coated onto one side of the woven material, and the coated backing was tufted at 1/10 gauge with a 1465 denier polypropylene tufting yarn to produce a cut pile carpet having an even visual appearance.

The grab strength of the tufted material was tested using an Instron tensile strength tester as described in Example 1. The tufted material exhibited a grab strength in the fill direction of 82 pounds and a grab strength in the warp direction of 147 pounds.

COMPARATIVE EXAMPLE 3

A tufted backing was prepared as in Example 3 except that lubricant was not added to the warp yarns used in the woven material. The tufted material exhibited an uneven appearance and reduced grab strength when compared to the tufted material of Example 3. The warp and fill direction grab strength of the backing made from non-lubricated serrated yarns were 124 and 38 pounds, respectively.

Example 3 and Comparative Example 3 show that any potential detrimental affect to extrusion coating adhesion posed by the use of a lubricant is outweighed by the benefit of having a lubricant present on the warp yarn.

While the foregoing Examples illustrate preferred embodiments of the invention, a wide variety of materials and construction techniques may be used in preparing primary backings useful in virtually any tufting application. The suitability of particular combinations of materials will, of course, depend on factors such as the ability of the selected yarns and lubricants to withstand the process conditions encountered in the polymer coating process, and the ability of the coating to adhere to the yarn in the presence of the selected lubricant.

Polypropylene yarns are preferred for preparing the woven material used in the backing, but other thermoplastic polymer yarns may be used, including, for example, yarns made from polypropylene-polyethylene blends, polypropylene-polyethylene terephthalate blends, polyesters, ethylene copolymers, propylene random copolymers and nylons. The yarns may include additives typically used in the intended application. Typical carpet industry additives include color concentrates, calcium carbonate fillers and delustering agents.

The preferred method of manufacturing serrated tape yarn for use in the invention is to extrude polypropylene through a die to form a sheet of serrated material of a width sufficient to produce several yarns when slit. Such sheets need only bear serrations on one side, although serrations may be provided on both sides of the sheet. Typically, the sheet will be water quenched immediately after extrusion. Water is then stripped from the tape, and the tape is slit into the desired widths. Slit tape is drawn through a drawing oven at a drawing ratio of from about 5:1 to 8:1, optionally relaxed between about 5 to 15 percent, and wound onto a spool for use in the weaving process. The tape may be lubricated while being wound onto the winder, if desired.

While the foregoing method of serrated yarn production is preferred, serrated yarns useful in the invention may prepared by other means well-known in the art. For example, a non-serrated tape yarn may be formed and subsequently serrated by mechanically operating on the tape yarn to provide the desired cross-sectional profile. Alternatively, individual serrated tape yarns may be formed by extruding a suitable thermoplastic through a die containing a plurality of openings having the desired cross-sectional profile.

While it is desirable that both warp and fill yarns be serrated, backings in accordance with the invention may be produced using a combination of serrated and nonserrated warp and fill yarns. If both serrated and nonserrated tape yarns are used in such backings, it is believed that at least 50 percent of the yarn used in the woven material should bear serrations on at least one of the two major yarn surfaces as measured on a surface area basis, preferably with at least 75 percent of the yarn being serrated. In this regard, it should be noted that in a typical application where serrations are present on only one side of a tape yarn, the serrated surface of the yarns will be randomly oriented with respect to a given surface of the woven material unless orientation of the tape yarn is controlled during the yarn production and weaving processes. In most applications, it will not be necessary to orient the serrations of the warp and/or fill yarns so that the serrations all appear on the same side of the woven material.

Figure 3A:
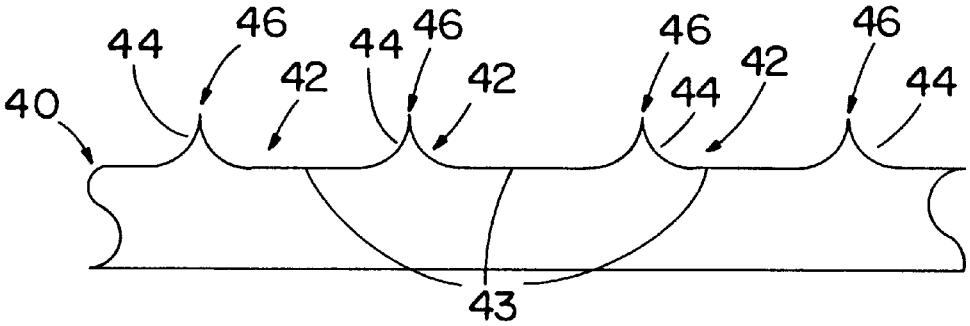
FIGS. 3*a* through 3*c* are cross sectional views of other serrated tape yarns useful in the invention.
Figure 3B:
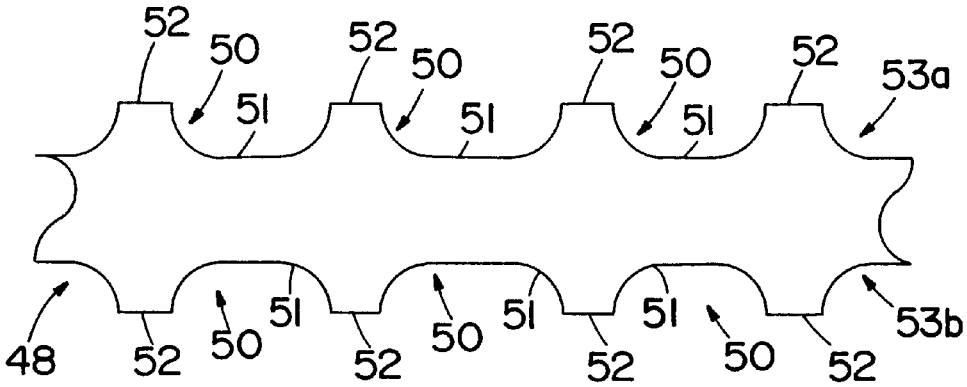
Figure 3C:
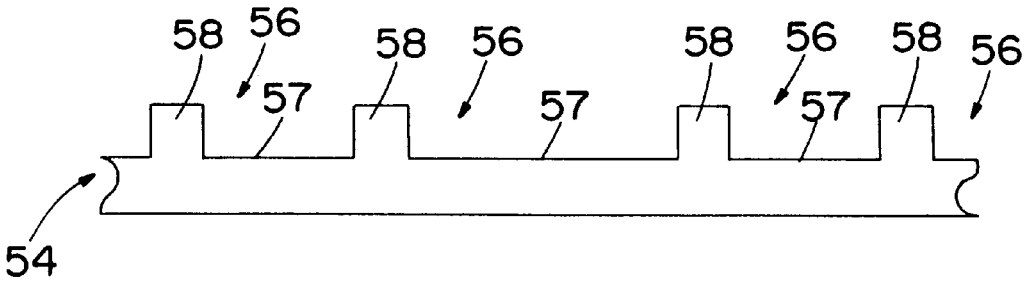

FIGS. 3*a* through 3*c* are cross sectional profiles of other types of serrated yarns useful in the invention.

In FIG. 3*a*, serrated yarn 40 has a plurality of serrations 42 including grooves 43 and ridges 44. Unlike mesas 22 in the yarn of FIG. 2, ridges 44 have angular tips 46. Our experiments have shown that while yarns with angular tips such as yarn 40 are useful in the invention, it is believed that backings prepared from such yarns exhibited less improvement in grab strength performance than those made from yarns having ridges with relatively flat tops as shown in FIG. 2.

FIG. 3*b* is a cross sectional profile of a yarn 48 having serrations 50 including grooves 51 and mesas 52 on major yarn surfaces 53*a* and 53*b*. While providing serrations on both major yarn surfaces is useful in the invention, the use of serrations on both sides of the tape yarn may render the yarn more susceptible to breakage. Such effects may in some cases be minimized by strategic placement of the serrations, such as by staggering the placement of the serrations on one major yarn surface with respect to the second major yarn surface. As used in this application, the term "major yarn surface" refers to a surface of the yarn which comprises more than about 25 percent of the surface area of the yarn. For example, when a yarn has a generally rectangular cross section as shown in FIG. 3*b*, the major yarn surfaces will be those including the wider dimensions of the rectangular cross section, which in this case are surfaces 53*a* and 53*b*.

FIG. 3*c* is a cross sectional profile of a yarn 54 having a number of irregularly spaced serrations 56 including channels 57 and ridges 58 having generally rectangular shapes.

FIGS. 3*a* through 3*c* exemplify the wide variety of serrated yarns that may be used in backings in accordance with the present invention. Other shapes will be apparent to those of ordinary skill in the art. The characteristics common to all such serrated yarns is that the yarns have at least one major surface that includes longitudinal serrations, regardless of the spacing or shape of the serrations, grooves or ridges.

Figure 4:
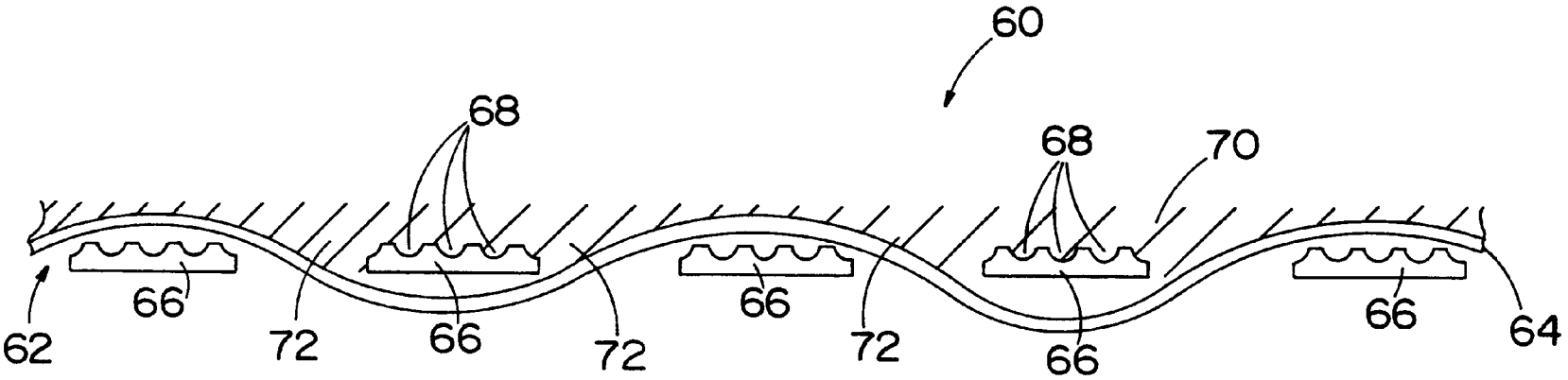
FIG. 4 is a cross-sectional view of a tuftable backing in accordance with the present invention.

FIG. 4 shows additional detail of a partial cross-section of a tuftable backing material 60 in accordance with the invention. In the backing of FIG. 4, a woven fabric 62 includes a serrated tape fill yarn 64 woven in a plain weave across a plurality of serrated tape warp yarns 66, each warp yarn 66 having three longitudinal channels 68. A thermoplastic coating 70 is adhered to fabric 62, and extends into channels 68 substantially filling channels 68. While a glue or adhesive may be used to attach fabric 62 to coating 70, coating 70 preferentially is adhered to fabric 62 by thermal bonding or other means without the use of supplemental adhesives or glues. Coating 70 also extends into intersticial spaces 72 between the woven yarns 64 and 66. While not wishing to be bound by the theory, it is believed that the enhanced performance of backings in accordance with the invention may be attributable to coating 70 conforming at least partially to the shape of channels, thereby locking the yarns in place within the backing material. While providing, this advantage, it is further believed that because coating 70 is relatively thin with respect to the thickness of yarns 64 and 66, coating 70 does not interfere with the tuftability of the yarn. It is also believed that the filling of channels 68 by coating 70 may be of particular importance when lubricated yarns 64 and 66 are used in fabric 62 as the cooperative interlocking action of coating 70 and channels 68 may help limit movement of yarns 64 and 66 that could otherwise easily occur if a coating was deposited on a lubricated flat yarn surface.

The pitch of the serrations (as illustrated by dimension P in FIG. 2) useful in tufted carpet applications typically will vary from about 1 serration per millimeter to about 5 serrations per millimeter with the range of 2 to 4 ridges per millimeter being preferred. The maximum thickness of such yarns as measured from the top of a ridge to the bottom of the tape yarn typically will range from 0.05 to 0.125 millimeters (2 to 5 mils), with a thickness of about 0.08 millimeters (3.25 mils) being preferred. The height that the ridges may rise above the lowest part of the serrations (as illustrated by dimension H in FIG. 2) typically will vary from about 0.025 to 0.1 millimeters (1 to 4 mils), with the range of 0.03 to 0.0625 millimeters (1.5 to 2.5 mils) being preferred. In general, we have found that backings formed from yarns having relatively higher ridges are more tuftable and that better face uniformity is obtained when all warp yarns used in a given backing are similarly serrated.

The denier of warp yarns used in typical carpet backings in accordance with the invention will run from about 300 to 600 and is preferred to be between 350 and 500. Fill yarns used in the invention typically will range from 500 to 1200 denier, with 600 to 1100 denier being preferred.

Woven material used in typical carpet backings will be plain woven material having about 7 to 14 warp yarn ends per centimeter (18–32 ends per inch) and from about 3 to 9 fill yarn ends per centimeter (8 to 22 ends per inch), although other warp and fill yarn numbers may be used in carpet or other tuftable material applications.

The use of serrated tape yarns in coated backings also makes it possible to reduce the number of fill yarns required to produce a backing having a given tensile strength. For example, a representative noncoated commercially available primary backing having about 9 warp ends per centimeter (24 ends per inch) and 6 fill yarns per centimeter (15 fill ends per inch) manufactured from 475 denier polypropylene warp yarn and 1050 denier polypropylene fill yarn and having a woven weight of about 84 grams per square meter (3.6 oz./sq. yd.) has a tensile strength as measured by the ASTM 1682 test for tensile strength of 120 pounds in the warp direction and 105 pounds in the fill direction. Backings in accordance with the present invention can attain this same strength using 9 warp ends per centimeter (24 ends per inch) and 4 fill yarns per centimeter (11 fill yarns per inch) construction requiring about only about 70 grams per square meter (3.0 oz./sq. yd.) of yarn, thereby offering an appreciable savings in raw material costs for the same backing strength.

A plain weave material is the weave typically preferred for tliftable commercial carpet backings. However, other weaves known in the art may be used in manufacturing backings in accordance with the invention, if so desired.

A polypropylene/polyethylene alloy such as the 75 percent polypropylene/ 25 percent polyethylene blend noted in the Example 1 is the preferred coating material for use with polypropylene yarns. We have found that the presence of a minor portion of a component such as polyethylene that has a lower melting point than the major blend component provides for easier and better extrusion coating than is obtained when the extrusion coating consists of a single, relatively high melting point polymer such as polypropylene. Other thermoplastic polymers, polymer blends or copolymers may be used successfully as the coating, however, if compatible with the particular coating process, yarn and lubricant selected.

Extrusion coating is the preferred method of providing the polymer film used in the backing as the use of extrusion coating is believed to provide greater strength than spray or roll coating operations. The coating typically will be between 0.08 millimeters (3 mils) and 0.001 millimeters (0.05 mils) thick, preferably between 0.04 millimeters (1.5 mils) and 0.02 millimeters (0.75 mils) thick, and is most preferred to be about 0.025 millimeters (1 mil) thick. Polypropylene used in the extrusion coating typically should have a flow rate of at least 30 grams per minute and preferably at least 50 grams per minute. While the extrusion coating may include additives, if desired, additives are typically not included in the extrusion coating material. It is preferred that the coated fabric be rolled between pinch rollers while the extrudate is hot to aid the filling of the yarn serrations by the hot extrudate.

Materials useful in the invention as tufting lubricants typically are organic oil-based. Preferred lubricants include fatty acids having functional groups of six to twenty-two carbon atoms and the methyl, ethyl and butyl straight-chain esters thereof. Refined or synthesized polyglycols or their esters of fatty acids or fatty triglycerides may be used, with the triglycarides exhibiting a higher temperature stability that may be useful where the selected extrusion coating requires higher temperature extrusion coating operating temperatures. Where the chemical stability of the lubricant is of extreme importance, more exotic lubricants such as esters of dibasic acids, aryl, alkyl and alkyl aryl phosphates, silicones, silicone glycols or silicate esters may be used, although the use of these more expensive lubricants typically will not be required.

The lubricant preferentially is applied only to the warp yarn used in the woven material, and preferentially is applied prior to weaving. If desired, however, lubricant may be applied to the fill yarn, or to both the warp and fill yarn. In the latter case, lubricant may be applied to the woven material by spraying or other means after weaving but prior to application of the extrusion coating. Alternatively, a lubricant may be applied to an extrusion coated fabric after the extrusion coating process has been completed, although this process is not preferred.

Primary backings in accordance with the invention may be tufted with the coated surface oriented toward the pile surface of the backing or away from the pile surface. It is preferred to tuft with the extrusion coating oriented toward the pile surface of a carpet, especially when lighter weight carpets are being produced, as the extrusion coating provides a matt finish that minimizes or eliminates the need to degloss the primary backing where the backing may be visible through the face yarn of the carpet.

Carpets can be prepared from our inventive backings in a variety of ways known to those skilled in the art. Typically, the tufted primary backing will first be washed, dyed or printed if desired, dried and finished. The finishing process typically includes the steps of applying a particulate-filled latex binder to the back of the tufted primary backing to secure the tufts in the primary backing and to adhere a secondary backing to the carpet. Alternately, the carpet may be finished using hot melt materials and/or thermoplastic adhesives as is known in the art.

The improved dimensional stability of a tufted primary backing prepared in accordance with our invention permits the tufted primary backing to be printed onto the tufted surface prior to application of the secondary carpet backing. A tufted primary backing is much easier to handle than a carpet complete with its latex filler and secondary backing, and in the event the tufted material is misprinted or otherwise spoiled, waste is minimized because the latex filler and secondary backing have not yet been applied to the tufted primary backing.

Our primary backings are especially well suited for use in the preparation of carpet tiles. Carpet tiles typically are prepared by processes which involve steps such as rolling, embossing, heating, cooling and drying which can induce stresses in the primary backing material. These stresses can result in the production of carpet tiles in which there are localized differences in the tension and shrinkage characteristics of the carpet backing. While these localized differences often are not apparent in large pieces of roll carpet, cutting the carpet into tiles provides a much greater opportunity for temperature and humidity to operate on the smaller carpet tiles, causing the localized differences to be expressed as curling of the tile edges. Because carpet tiles frequently are laid rather than glued in place, even a minor amount of curling can result in destruction of the tiled surface when an edge curls up and is caught by a passing object.

The improved dimensional stability of our carpet should better resist forces placed on a primary tufted material during the tile production process, thereby minimizing or eliminating curling in the finished tiles.

Our backings provide an additional advantage in carpet tile applications because the locking of the warp and fill yarns by the extrusion coating results in cleaner, less frayable edges which, while important to carpet generally, are critical to successful carpet tile installation and wear, as well as in similar applications such as spot or throw rugs.

Our backings also provide performance advantages when used to prepare carpet for the automotive market. In typical automotive applications, carpet is prepared by tufting a primary backing, extruding a coating of thermoplastic binder onto the tufted primary backing, followed by a second extrusion coating of a highly filled thermoplastic resin to improve noise attenuating performance of the carpet, and thereafter molding the carpet piece to conform to the scope of a vehicle floor. Carpets prepared in this manner should exhibit improved dimensional conformity and raveling resistance for the reasons already discussed above in connection with carpet tile applications.

The foregoing descriptions are provided by way of example only. Other embodiments of the invention will be apparent to those of ordinary skill. The scope of the invention, therefore, is intended to be defined only by the claims set forth below.

We claim:

1. A tuftable backing comprising:

a fabric woven from warp and fill yarns comprising thermoplastic serrated tape yarn comprising at least 85 weight percent polypropylene, wherein at least 50 percent of the yarns in the woven fabric are serrated;

a thermoplastic polymeric layer adhered to the fabric, said polymeric layer comprising about 50 to 90 weight percent polypropylene and about 10 to 40 weight percent polyethylene; and optionally a tufting lubricant.

2. The backing of claim 1 wherein the serrated tape yarn includes a surface comprising a plurality of longitudinal grooves and a plurality of longitudinal mesas rising above and between the grooves.

3. The backing of claim 1 wherein tufting lubricant has been applied to warp or fill yarns.

4. The backing of claim 1 wherein the layer has been extrusion coated onto the fabric and wherein the backing further includes the tufting lubricant.

5. The backing of claim 4 wherein the serrated tape yarns include yarns having a surface comprising a plurality of longitudinal grooves and plurality of longitudinal mesas rising above and between the grooves.

6. The backing of claim 5 wherein at least 75 percent of the yarns are serrated, and wherein the layer comprises at least 70 weight percent polypropylene and at least 15 weight percent polyethylene.

7. The backing of claim 4 wherein the woven material contains 20 to 28 warp yarns per inch, 6 to 12 fill yarns per inch, wherein the grab strength in the warp direction is at least 130 pounds, and wherein the grab strength in the fill direction is at least 70 pounds.

8. The backing of claim 6 wherein the woven material contains 20 to 28 warp yarns per inch, 6 to 12 fill yarns per inch, wherein the grab strength in the warp direction is at least 130 pounds, and wherein the grab strength in the fill direction is at least 70 pounds.

9. A tufted carpet comprising:

a primary backing including a fabric woven from at least 50 percent thermoplastic serrated tape yarns comprising at least 85 weight percent polypropylene, a thermoplastic polymeric layer comprising about 50 to 90 weight percent polypropylene and about 10 to 40 weight percent polyethylene adhered to the woven fabric, and a tufting lubricant applied to at least a portion of the serrated tape yarns; and face yarn tufted through the primary backing thereby forming a carpet pile surface comprising face yarn tufts extending outwardly from the primary backing.

10. The carpet of claim 9 wherein the serrated tape yarn includes a surface comprising a plurality of longitudinal grooves and plurality of longitudinal mesas rising above and between the grooves.

11. The carpet of claim 9 wherein the primary backing is oriented so that a polymeric film surface of the backing is oriented toward the carpet pile surface.

12. The carpet of claim 11 in the form of carpet tiles.

13. The carpet of claim 11 wherein the carpet is molded into the passenger compartment of a vehicle.

14. The carpet of claim 9 wherein the fabric is woven from at least 75 percent serrated tape yarns, wherein the layer has a thickness between about 0.08 and 0.001 millimeters, wherein the serrated tape yarn includes a surface comprising a plurality of longitudinal grooves and a plurality of longitudinal mesas rising above and between the grooves, and wherein the carpet further includes a secondary backing attached to said primary backing with an adhesive binder.

15. A process for producing a primary carpet backing comprising the steps of:

weaving a plurality of yarns comprising serrated tapes bearing longitudinal serrations comprising longitudinal grooves and longitudinal ridges into a woven fabric;

extrusion coating a thermoplastic material onto the woven fabric; and applying pressure to the extrusion coated fabric to force the extruded material into at least some of the longitudinal grooves.

16. The process of claim 15 wherein the serrated tape yarns have been drawn at a draw ratio between about 6:1 and 7:1.

17. The process of claim 15 further including the step of lubricating at least a portion of the serrated tape yarn prior to weaving the serrated tape yarn into the woven material.

18. The process of claim 15 wherein at least a portion of the serrations include longitudinal mesas rising above and between the longitudinal grooves.

19. The process of claim 18 wherein the weaver step includes the step of weaving serrated wrap and serrated fill yarns to produce the woven material.

20. A tuftable backing comprising:

a fabric woven from yarns comprising thermoplastic tape yarns having at least one longitudinal channel on at least one major yarn surface; and a thermoplastic coating adhered to said fabric, said thermoplastic coating extending into said longitudinal channels and filling at least fifty percent of the channels' cross-sectional area.

21. The backing of claim 20 wherein the longitudinal channels have a cross-sectional area and wherein the coating fills at least 90% of the channel's cross-sectional area.

22. The backing of claim 20 wherein the tape yarn comprises at least 85 weight percent polypropylene and wherein the coating comprises between 50 to 90 weight percent polypropylene and 10 to 40 weight percent polyethylene.

23. The backing of claim 20 wherein the woven material comprises warp yarns having a width of between 0.5 and 2 centimeters and 1 to 4 longitudinal channels on a major warp yarn surface and further comprising fill yarns having a width of 1 to 5 centimeters and from 2 to 8 longitudinal channels on a major fill yarn surface, and wherein the coating has an average thickness of between about 0.01 to about 0.10 millimeters.

24. The backing of claim 23 wherein the fabric has 7 to 14 warp yarns per centimeter and 3 to 9 fill yarns per centimeter.

25. The backing of claim 22 wherein the woven material comprises warp yarns having a width of between 0.5 and 2 centimeters and 1 to 4 longitudinal channels on a major warp yarn surface and further comprising fill yarns having a width of 1 to 5 centimeters and from 2 to 8 longitudinal channels on a major fill yarn surface, wherein the coating has an average thickness of between 0.01 to 0.10 millimeters, and wherein the coating fills at least 90 percent of the longitudinal channel cross-sectional area.

26. The backing of claim 20 wherein the thermoplastic coating has been adhered to the woven material by applying molten thermoplastic to the woven material and thereafter applying pressure to the molten thermoplastic to force the molten thermoplastic into the longitudinal serrations.

27. The backing of claim 25 wherein the thermoplastic coating has been adhered to the woven material by applying molten thermoplastic to the woven material and thereafter applying pressure to the molten thermoplastic to force molten thermoplastic into the longitudinal serrations.

28. The backing of claim 20 wherein the thermoplastic coating is adhered to the woven fabric without the use of an adhesive material.

* * * * *